United States Patent [19]

Labbé

[11] Patent Number: 4,503,747

[45] Date of Patent: Mar. 12, 1985

[54] CAPO

[76] Inventor: Clément Labbé, 1401 De Lanaudière St., Apt. 6, Joliette, Quebec, Canada, J6E 3N9

[21] Appl. No.: 557,914

[22] Filed: Dec. 5, 1983

[51] Int. Cl.[3] ..... G10D 3/04

[52] U.S. Cl. ..... 84/318

[58] Field of Search ..... 84/315–318

[56] References Cited

U.S. PATENT DOCUMENTS

| | | | |
|---|---|---|---|
| 583,102 | 5/1897 | Utt | 84/318 |
| 3,598,012 | 8/1971 | Dunlop . | |
| 3,722,346 | 3/1973 | Valentino . | |
| 3,933,073 | 1/1976 | Hutchins . | |
| 3,933,077 | 1/1976 | Dunlop . | |
| 4,048,894 | 9/1977 | Myerson et al. . | |
| 4,165,670 | 8/1979 | Cahn . | |
| 4,252,046 | 2/1981 | Myerson et al. . | |
| 4,412,472 | 11/1983 | Welch | 84/318 |

FOREIGN PATENT DOCUMENTS

| | | | |
|---|---|---|---|
| 508395 | 6/1955 | Italy | 84/318 |

*Primary Examiner*—Lawrence R. Franklin

[57] ABSTRACT

A capo for stringed instruments comprising a rollable cylindrical pressure member mounted at its opposite ends by a central rod extending in its central longitudinal axis. A neck attachment member, in the form of a flexible strap, extends around the undersurface of the neck and is secured to a pair of transversely-spaced mounting elements by means of an elastic tensioning member. The mounting elements also support the rod. The tensioning member is tensionally adjustable. The capo is adapted for permanent installation on a stringed instrument. A position-locking foot is provided for the capo when it is used with stringed instruments of the fretted type.

7 Claims, 8 Drawing Figures

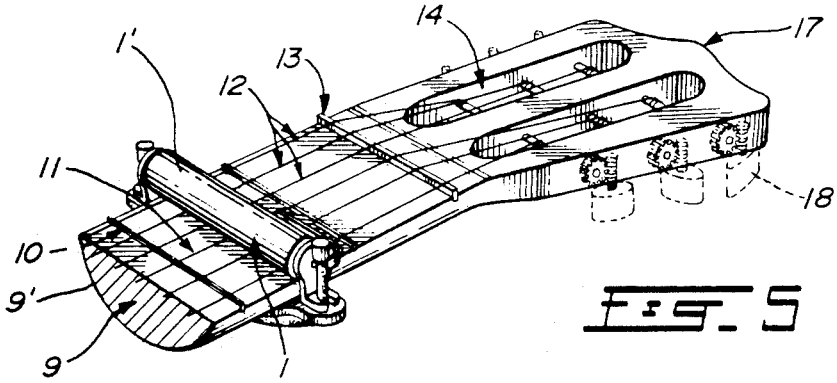
FIG. 5
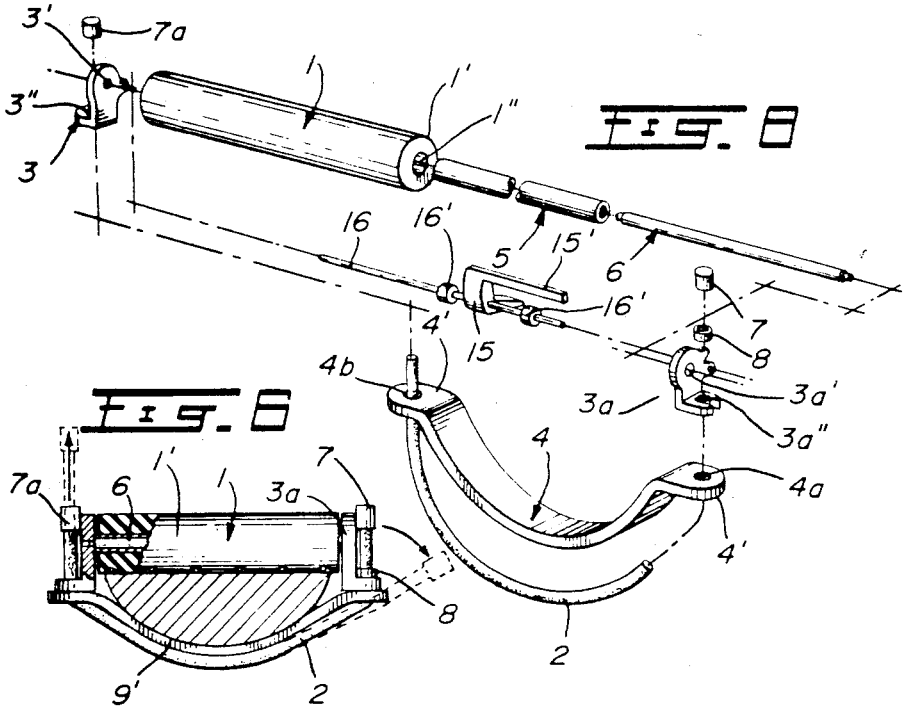
FIG. 8
FIG. 6
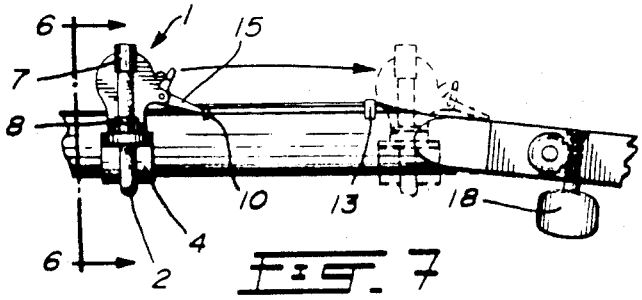
FIG. 7

CAPO

FIELD OF THE INVENTION

This invention relates to a clamp-like attachment for stringed instruments known as a capo or capotasto, more specifically to a new and improved such capo.

BACKGROUND OF THE INVENTION

Stringed instruments all have an elongated neck over which extend a plurality of spaced-apart longitudinal strings which are tied or otherwise fastened under tension at their opposite ends. The instruments to which this invention is particularly directed include guitars, banjos, mandolins, etc., i.e. those types of stringed instruments having frets on the fingerboard. A fret is a thin transverse bar embedded in the wood of the fingerboard which the musician uses to sound a desired note by pressing with a finger on a string immediately behind a fret. (For descriptive purposes, the soundbox of the instrument will hereinafter be referred to as the "forward" end of the instrument, while the head of the instrument will be called the "rear" end).

The invention is also directed, however, to stringed instruments without frets, such as those of the violin family.

A capo, then, is a device having a pressure member urged towards contact with all the strings, transversely thereto and behind a fret, as is well known. The prior art teaches many such capos, all of which are adapted to shorten the effective length of the strings to raise their pitch and also vary the timbre of the sound as desired. For example, the subject of the U.S. Patent to Myerson et al issued on Feb. 24, 1981 and bearing U.S. Pat. No. 4,252,046 teaches a capo having a pressure bar 16 having differently-shaped surfaces adapted to press against the strings and secured in place by an elastic mounting strap 18. The pressure bar 16 of this Patent would be relatively expensive to manufacture. Moreover, there is a possibility that sliding the capo from one fret to another might result in uneven pressure exerted on the strings by the pressure bar if the latter is even slightly transversely disaligned. The result is that one or more of the strings would be "bent" ("bending" of a string means transverse movement thereof at a given point on the fingerboard, which raises slightly the pitch of the string). Thus, the relative pitches of the strings would change, putting the instrument out of tune.

It will be noted that there is no adjustment means for the tension of mounting strip 18. Another undesirable possibility, therefore, is that moving the capo forwardly or rearwardly will cause one or more of the strings to "buzz" against the selected fret due to the fact that the neck of a stringed instrument tapers gradually rearwardly, thereby changing the tension exerted by the mounting strap 18. At best one or more strings might sound unclearly if not actually "buzz".

The two above-mentioned undesirable possibilities, namely string "bending" and/or "buzzing" are common to all sliding or slidable capos in the prior art because of their basic design. The design predominantly consists of some kind of string-contacting pressure bar biased against the strings by an elastic member passing around the neck of the instrument and secured to prongs projecting transversely of the pressure bar at its opposite ends. For example, reference can be had to the U.S. Patent issued to Cahn Aug. 28, 1979 and bearing U.S. Pat. No. 4,165,670; the U.S. Patent to Hutchins issued Jan. 20, 1976 and bearing U.S. Pat. No. 3,933,073 (the latter Patent being of different design); the U.S. Patent issued to Valentino on Mar. 27, 1973 and bearing U.S. Pat. No. 3,722,346; and the U.S. Patent granted to Utt on May 23, 1897 and having U.S. Pat. No. 583,102.

As for those capos which are not conceived as being easily slidable, being rather temporarily lockingly positioned at a given fret, their main disadvantages are that two hands are required to move the capo when needed and that they must be readjusted at each new fret.

One further disadvantage is that, until now, all capos have been completely removed from the instrument when not needed and, hence, must be kept somewhere if they are not to be lost.

OBJECTS OF THE INVENTION

In view of the above, it is an important object of the present invention to provide a capo having a rollable pressure member urged towards the strings of a stringed instrument by a slidable attachment member and tensioning member, whereby the capo may be easily and precisely positioned at any fret simply by sliding the capo with one hand; and whereby the capo will not produce "bending" and/or "buzzing" of the strings.

It is another object of the invention to provide a capo of the character described which can be slid behind the nut of the instrument when not needed, thereby remaining permanently attached to the instrument.

It is a further object of the invention to provide a capo of the character described which embodies a tensioning member extending with the attachment member, the former being tensionally adjustable.

It is a still further object of the invention to provide a capo of the character described which is adapted to fit both transversely flat and transversely convex fingerboards.

It is yet another object of the invention to provide a capo of the character described which has a simple position-locking means that can be engaged and disengaged by one hand.

It is still another object of the invention to provide a capo of the character described which is aesthetic in appearance and inexpensive to produce, yet very durable.

SUMMARY OF THE INVENTION

The above and other objects and advantages of the invention are realized according to a preferred embodiment of the capo comprising a rollable pressure member adapted to exert an even transverse pressure on all the strings of a stringed instrument; a neck attachment member adapted to transversely closely fit the undersurface of the neck of the same; and a tensioning member adapted to positively urge the pressure member into contact with the strings and against the fingerboard of the instrument.

The pressure member takes the form of a solid cylindrical roller, preferably made of a semi-resilient material and having a central through bore. A rigid, preferably semi-flexible sleeve, is preferably disposed in the through bore and frictionally or otherwise permanently secured to the roller. A rigid, preferably semi-flexible rod, is provided, extending through the sleeve and having opposite ends projecting transversely out of both sides of the roller.

The roller is slightly longer than the width of the fingerboard at the widest section of the latter (adjacent the soundbox or front end).

The attachment member is in the form of a strap made of pliable material and adapted to extend in the same transverse plane as the pressure member around the generally semi-circular undersurface of the neck. Both ends of the strap are formed with first tensioning member retaining means.

Both opposite ends of the rod of the roller are fixedly, but preferably releasably, secured to a pair of transversely-spaced mounting elements, each of the latter having a first portion lying in a plane parallel to the longitudinal axis of the instrument neck, and a second transversely-projecting portion lying in a plane parallel to that of the instrument fingerboard. The mounting elements thus have an L-shape profile. The rod is secured in holes made therefor in the upper portions of the two mounting elements located on either side of the fingerboard and spaced outwardly of the latter.

The tensioning member is preferably realized of an elongated elastic cord covered by a suitable tough long-lasting material. This cord is made to extend along the outer surface of the attachment member and through the retaining means of the latter, then upwardly through the second portions of the mounting elements wherein is formed a second tensioning member retaining means. This particular arrangement allows for adjustment of the tension exerted by the end portions of tensioning member on the roller, as will be explained below. Preferably, the second retaining means of one of the mounting elements releasably retains the elongated cord to enable a player to remove the capo from the instrument to change the strings.

The capo thus described is slidable along the neck of the instrument, either forwardly or rearwardly, because of the pliability of the neck-attachment member which will closely conform to the cross-sectional shape of the neck at any position therealong and because the pressure member can roll about its longitudinal axis along the fingerboard. The tensioning member is designed to tensionably adjust for the entire length of the fingerboard, but can be more precisely and instantly adjusted for any given position. Moreover, the capo is envisioned as remaining attached to its instrument permanently: when not needed, it can easily be slid over the nut to the head of the instrument (the rear end).

The above will be more clearly understood by having reference to the preferred embodiment of the invention, illustrated by way of the accompanying drawings, in which:

FIG. 5 is another perspective view of the capo, also showing the rear portion of a stringed instrument to which the capo is attached;

FIG. 6 is a cross-sectional view taken along line 6—6 of FIG. 7;

FIG. 7 is a side elevation of the capo attached to the neck of the instrument, also showing in phantom lines the same capo in non-use position behind the nut of the neck; and FIG. 8 is an exploded perspective view of the components of the capo.

Like reference symbols indicate like elements throughout the drawings.

DETAILED DESCRIPTION OF THE INVENTION

Figure 1:
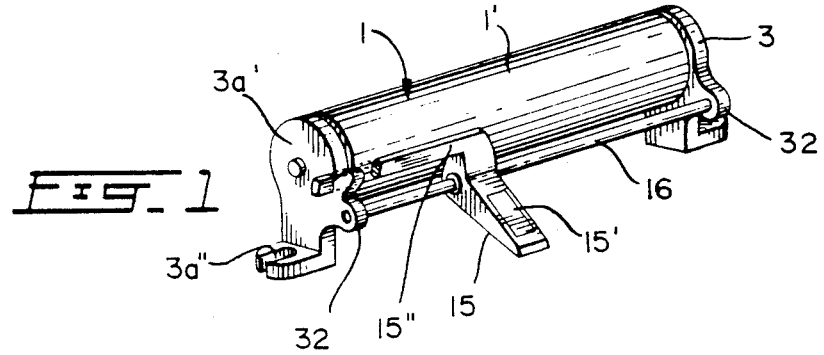
FIG. 1 is a perspective view of the capo according to the preferred embodiment.
Figure 2:
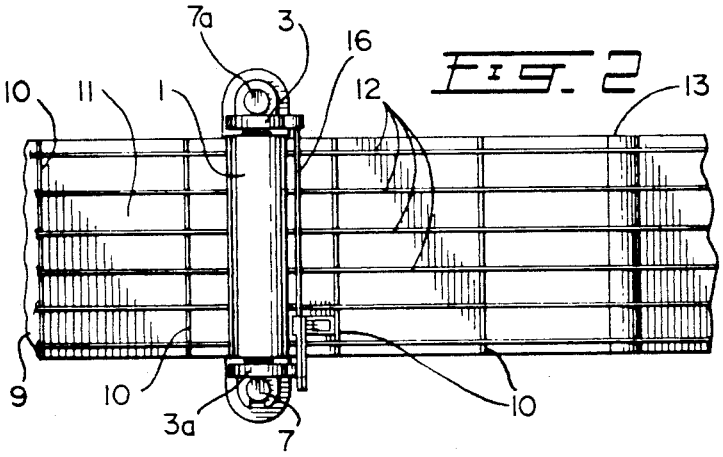
FIG. 2 is a top plan view of the capo of FIG. 1 attached to the rear portion of the neck of a stringed instrument.

The capo 1 of the invention is adapted for attachment to the neck of a standard stringed instrument, such as the guitar shown in the drawings. Guitar 17 has a fingerboard 11 which is shown as being transversely flat but it may also be tranversely curved, as is known. As clearly shown in FIGS. 5 and 6, neck 9 has a generally semi-circular undersurface 9'. Neck 9 terminates in a head on rear end 14 having tuning page 18 which retain a plurality of longitudinally-extending, spaced-apart strings 12 under tension. Fingerboard 11 is separated from rear end 14 by a nut 13 over which strings 12 pass and is formed with a plurality of transverse longitudinally-spaced frets 10.

Referring now to FIGS. 1 and 8, capo 1 is shown more advantageously, including a pressure member in the form of a cylindrical roller 1', preferably made of a semi-resilient rubber material. The longitudinal axis of roller 1' has a through bore 1'' adapted to receive a fixedly-secured, semi-rigid sleeve 5. A rigid but semi-flexible rod 6 extends freely through sleeve 5, whereby roller 1' can revolve about its longitudinal axis. Roller 1', sleeve 5 and rod 6 are all slightly flexible in case the neck 9 is slightly transversely convex, so that roller 1' can still closely contact the strings 12.

Rod 6 is mounted at its opposite ends in a pair of mounting elements 3 and **3*a*, both having an L-shaped profile formed of an upright upper portion and a transversely-projecting lower portion. The upper portions of elements 3, 3*a* are provided with holes 3', 3*a'* for rod 6. Thus, roller 1' is rollable along fingerboard 11 about its longitudinal axis and rod 6**.

The attachment member consists of a strap 4 made of durable, pliable and slippery material, such as a suitable type of plastic. Strap 4 closely conforms to the shape of the undersurface of neck 9 and is formed at its outer ends with transverse flat ears 4', each of the latter being formed with a hole **4*a* and 4*b*. Ears 4'** constitute the first tensioning member retaining means.

The tensioning member itself is an elongated flexible and elastic cord 2. The cord is preferably made of a plurality of rubber fibres or strings covered by a tough protective nylon sheath.

FIG. 6 clearly shows how capo 1 is mounted on guitar neck 9. Roller 1' is arranged transversely of fingerboard 11, while rod 6 is mounted in holes 3' and **3*a'* of mounting elements 3, 3*a*. Then strap 4 is placed around the undersurface of neck 9, such that it lies in the same vertical plane as roller 1'. Cord 2 is extended around strap 4, exteriorly thereof, its two end portions being passed through holes 4*a* and 4*b* in ears 4'. The latter abuttingly underlie the corresponding lower portion of mounting elements 3, 3*a*. The second tension member retaining means is defined by a hole 3'' made in mounting element 3 and a notch 3*a''* made in the opposite mounting element 3*a*. The end portions of cord 2 therefore also extend upwardly through hole 3'' and notch 3*a''*, thereby connecting mounting elements 3, 3*a* to the ears 4' of strap 4**.

Cord 2 is kept in position at element 3a by a small ring clip 8 fixedly surrounding cord 2 and adapted to abut on the upper surface of the lower portion of element 3a. Both opposite ends of cord 2 are fitted with caps 7, 7a.

The tensioning means for cord 2 inheres in its elastic nature: pulling upwardly on cap 7a at the left side of FIG. 6 will obviously increase the tension of cord 2. Since cord 2 is elastic, it will become thinner in diameter as it is pulled. Then when released, its end portion above the lower portion of mounting element 3 will immediately elastically thicken, thereby not slipping through hole 3" and match 3a" and maintaining its tension. The ends of cord 2 are fitted with caps 7, 7a to facilitate tensioning and to embellish the capo. FIG. 6 shows how cord 1 can be disengaged from notch 3a" by a simple transverse outward pulling motion (shown in phantom lines).

Figure 3:
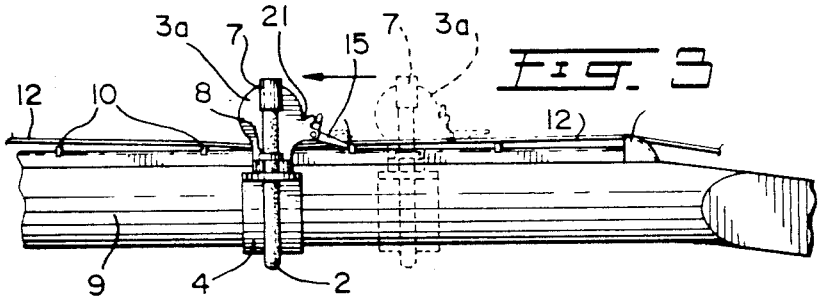
FIG. 3 is a side elevation of FIG. 2.
Figure 4:
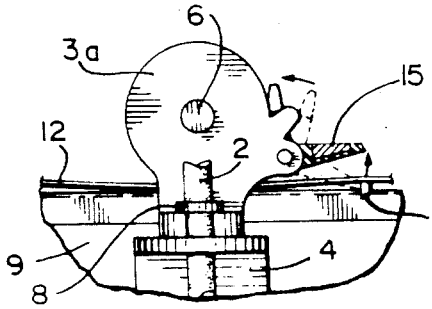
FIG. 4 is an enlarged side elevation of one side of the capo of FIG. 3, showing the locking means in released position.

It will be readily appreciated that the capo 1 is adapted to remain permanently attached to the neck of a stringed instrument. Roller 1' can be easily moved from one fret to another and slippery strap 4 will slide along with it. FIG. 3 illustrates this. When a player decides not to use the capo, it can be slid over nut 13 onto the rear end of the instrument, as shown in dotted line in FIG. 7. In this position, the capo does not affect the tone and the pitch of the strings, since the tension on the strings in this area is too high to be affected by the capo pressure. To move the capo back over the nut 13, the player pushes upwardly against ears 4' of strap 4 while moving strap 4 towards the front of the instrument. The particular instruction of capo 1 ensures that all strings 12 will be effectively evenly biased against the fingerboard 11 in various positions thereon.

An essential feature of the invention is the position-locking means mentioned above for fretted stringed instrument. This means is designed to prevent rearward movement of the capo which might occur should a player's left hand inadvertently strike the capo, and consists of a small rearwardly-extending foot 15 pivotally secured to a transversely-extending spindle 16, the latter being secured in rearward projections 32 integrally formed with the upper portions of elements 3 and 3a. Foot 15 is provided with a small weight 15' to bias it downwardly and is kept in adjusted transverse position by a pair of small rings 16' frictionally secured to spindle 16 (cf. FIG. 8). Foot 15 thus acts as a stopper for capo 1 and is preferably positioned between the first and second strings, since that is where the capo is most likely to be disturbed by the left hand.

As best seen in FIG. 7, foot 15 in downward position is stopped against the fret immediately behind the capo position. Foot 15 is released from this stopped position by an integrally-formed transversely-extending arm 15" (FIG. 1), the outer end of which releasably lockingly engages a small notch 21 formed in mounting element 3a. Of course, for a left-handed player, the position and orientation of foot 15 would be reversed.

One further advantage of the invention worthy of note is that a player can move capo 1 forwardly or rearwardly with the thumb of the left hand while simultaneously continuing to play chords or single notes with his/her other fingers. Thus, the capo of the present invention lends itself to musical modulation.

What I claim is:

1. A capo for a stringed instrument having an elongated neck and fingerboard, comprising: a pressure member adapted to be mounted transversely of said neck and capable of rolling displacement about its longitudinal axis; said pressure member being in the form of a cylindrical roller formed with a central through bore, having a sleeve extending through said through bore and fixed thereto, and having a rod extending through said sleeve, whereby said roller can rotate about said rod; a pair of transversely-spaced mounting elements located at either end of said pressure member and supporting the same; each said mounting element having an upper portion transverse to said rod, and a lower outwardly-projecting portion generally normal to said upper portion; said mounting elements thereby having an L-shape profile; said rod having its outer ends fixed in holes made therefor in said upper portion of said mounting elements; a neck attachment member adapted to transversely, closely fit the undersurface of said neck and lying in the same transverse plane as said pressure member, a releasable position-locking means; an elastic tensioning member extending around the exterior surface of said attachment member; the latter being formed with first tensioning member retaining means at both its ends; said pair of mounting elements being provided with a second tensioning member retaining means, whereby said attachment member is slidable with the rolling movement of said pressure member and said tensioning member positively urges the pressure member into even contact with the strings of said instrument and against said fingerboard.

2. A capo as defined in claim 1, wherein said position-locking means includes a transverse spindle secured at its ends to said upper portions of said mounting elements; a longitudinal rearwardly-extending foot pivotally secured at its forward end to said spindle; said foot having an integral transverse outwardly-extending arm, the outer end of which is adapted to releasably engage a notch formed in one of said upper portions.

3. A capo as defined in claim 1, wherein said attachment member consists of a soft pliable strap having a transverse ear at both its opposite ends; both said ears being formed with a hole, the latter constituting said first tensioning member retaining means.

4. A capo as defined in claim 3, wherein said tensioning member is an elongated elastic cord havng two opposite end portions.

5. A capo as defined in claim 3, wherein both said lower portions of said mounting elements are formed with holes, constituting said second tensioning member retaining means.

6. A capo as defined in claim 5, wherein each said opposite end portion of said cord is extended through said first and said second tensioning member retaining means, one of said opposite end portions having a rigidly-fixed ring clip adapted to abut against the top surface of one of said lower portions of said mounting elements, the other of said opposite end portions slidable through the hole of the other of said lower portions, and, when released, will not slip through said last-named hole, whereby said cord, under tension, holds said roller against said fingerboard and the cord tension is adjustable.

7. A capo as defined in claim 6, wherein one of said lower portions of said mounting elements is formed with a notch, whereby said cord can be disengaged therefrom.

* * * * *